US006354282B1

(12) United States Patent
Yoshii et al.

(10) Patent No.: US 6,354,282 B1
(45) Date of Patent: Mar. 12, 2002

(54) FUEL LIMITATION DEVICE FOR ENGINE WITH SUPERCHARGER

(75) Inventors: Osamu Yoshii; Hidemasa Tsuji; Tomoyoshi Sakano, all of Sakai (JP)

(73) Assignee: Kubota Corporation, Osaka (JP)

( * ) Notice: Subject to any disclaimer, the term of this patent is extended or adjusted under 35 U.S.C. 154(b) by 0 days.

(21) Appl. No.: 09/797,838

(22) Filed: Mar. 5, 2001

(30) Foreign Application Priority Data

Sep. 19, 2000 (JP) ..... 2000-282799
Sep. 19, 2000 (JP) ..... 2000-282802

(51) Int. Cl.[7] ..... F03N 33/00
(52) U.S. Cl. ..... 123/564; 123/599.1
(58) Field of Search ..... 123/564, 599.1

(56) References Cited

U.S. PATENT DOCUMENTS 4,565,178 A * 1/1986 Nagase et al. ..... 123/564
5,115,788 A * 5/1992 Sasaki et al. ..... 123/564
5,427,079 A * 6/1995 Andrepont, Jr. et al. 123/564 X

FOREIGN PATENT DOCUMENTS

JP 62-199932 9/1987

* cited by examiner

*Primary Examiner*—Hoang Nguyen
(74) *Attorney, Agent, or Firm*—Bacon &Thomas PLLC

(57) ABSTRACT

A fuel meter (21) of a fuel injection pump is made movable for fuel metering through a governor lever (14). A swing lever (31) has a power input point (J) which engages with a boost actuator (26). If the boost actuator (26) operates in response to a delayed rise of a supercharged pressure (P), a power output point (K) of the swing lever (31) inhibits the fuel meter (21) from moving for fuel increase. A governor lever (14) is connectably and separably opposed to the fuel meter (21) from a fuel increase side and a start spring (18) urges the fuel meter (21) toward a starting fuel increase side. The swing lever (31) has a pivot axis (Q) displaceable by an actuator (40). When making a cold start, the actuator (40) does not operate to thereby confine the fuel meter (21) to a starting fuel increase position by the power output point (K) positioned on a fuel increase side. When making a warm start, the power output point (K) positioned on a fuel decrease side confines the fuel meter (21) to a starting fuel decrease position (Ls).

6 Claims, 9 Drawing Sheets

FUEL LIMITATION DEVICE FOR ENGINE WITH SUPERCHARGER

BACKGROUND OF THE INVENTION

1. Field of the Invention

The present invention relates to a fuel limitation device for a diesel engine with a supercharger and particularly concerns a technique for inhibiting fuel increase at the time of quick acceleration by a diaphragm-type boost actuator, while securing a starting fuel increase.

2. Explanation of Related Art

There are conventionally known examples of the fuel limitation device for an engine with a supercharger such as shown in FIG. 11 (prior art 1) and in FIG. 12 (prior art 2).

As shown in FIG. 11, the prior art 1 comprises a fuel meter 21 of a fuel injection pump for an engine (E) with a supercharger, made movable for fuel metering through a double governor lever 14 of a centrifugal governor 10. A swing lever 31 is supported by a pivot axis (Q) and has a power input point (J) which engages with an output rod 30 of a diaphragm-type boost actuator 26. The swing lever 31 has a power output point (K) which faces the fuel meter 21 from a fuel increase side (R) of the fuel meter 21. If the boost actuator 26 operates in response to a delayed rise of a pressure (P) supercharged to the engine (E), the power output point (K) of the swing lever 31 inhibits the fuel meter 21 from moving for fuel increase.

The boost actuator 26 projects the output rod 30 with the supercharged pressure (P) against a return spring 28. Then it limits an excessive fuel supply caused by the delayed rise of the supercharged pressure (P) attributable to a rotation delay of the supercharger (turbo-charger) at the time of quick acceleration and the like to thereby prevent the generation of black smoke and the wasteful fuel consumption. Further, there is disposed a push rod (M) which strongly pushes out the fuel meter 21 to a starting fuel increase position against the return spring 28 of the boost actuator 26 when starting the engine (E). Here, in FIG. 11, numerals 2 and 3 designate a turbine and a compressor of the supercharger. Numeral 4 indicates a waste gate valve which reduces an excessive exhaust pressure caused by exhaust gas (C) produced at the time of a high-speed operation. Numerals 5, 6, 8, 11, 12 and 13 show an intake pipe, an exhaust pipe, a supercharged pressure communication pipe, a speed control operation lever, a speed control lever, and a governor spring, respectively. Numerals 14a and 14b indicate a first lever and a second lever forming a double governor lever 14. Numeral 15 designates a pivot axis of the governor lever 14. Numerals 16, 18 and 46 show a torque-up device, a start spring and a governor sleeve, respectively.

As shown in FIG. 12, the prior art 2 comprises a fuel meter 21 of a fuel injection pump for an engine with a supercharger, made movable for fuel metering through a double governor lever 14 of a centrifugal governor 10. A swing lever 31 is supported by a pivot axis (Q) and has a power input point (J) which engages with an output rod 30 of a diaphragm-type boost actuator 26. The swing lever has a power output point (K) which faces the fuel meter 21 from a fuel increase side (R) of the fuel meter 21. If the boost actuator 26 operates in response to a delayed rise of a pressure (P) supercharged to the engine (E), the power output point (K) of the swing lever 31 inhibits the fuel meter 21 from moving for fuel increase. An actuator 40 displaces the pivot axis (Q) to position the power output point (K) of the swing lever 31 on the fuel increase side (R) or a fuel decrease side (L). When making a cold start of the engine, the actuator 40 has its output rod 35 retracted to move the fuel meter 21 for fuel increase by the power output point (K) of the swing lever 31, thereby cancelling a fuel limitation function of the boost actuator 26. After the engine has started, the boost actuator 26 maintains the fuel limitation function.

SUMMARY OF THE INVENTION

According to the prior arts 1 and 2, it is possible to prevent the generation of black smoke and the wasteful fuel consumption by limiting the excessive fuel supply attributable to the delayed rise of the supercharged pressure (P). However, they have to be still improved on the following points.

When starting the engine, since no boost pressure acts on the boost actuator 26 and the output rod 30 is retracted, the power output point (K) of the swing lever 31 prevents the fuel meter 21 of the fuel injection pump from moving to a starting fuel increase position.

Then the prior art 1 requires to separately provide a push rod (M) which pushes out the fuel meter 21 to the starting fuel increase position against the return spring 28 of the boost actuator 26 when starting the engine. This needs a strong driving force which pushes out the push rod (M) against the return spring 28 of the boost actuator 26. On the other hand, if the fuel meter 21 always exists at the starting fuel increase position when starting the engine, excessive fuel is supplied at the time of making a warm start to result in entailing a problem of generating black smoke and consuming fuel wastefully.

Further, the prior art 2 retracts the output rod 35 of the actuator 40, thereby enabling the power output point (K) of the swing lever 31 to move for fuel increase when starting the engine. Therefore, it can solve the disadvantage of the prior art 1. However, the output portion 17 of the governor lever 14 unseparably engages with the fuel meter 21 of the fuel injection pump. This requires setting a resilient force of the return spring 28 of the boost actuator 26 to have such a strength as substantially balancing an extension force of the governor spring 13 at the time of quick acceleration so that the boost actuator 26 can inhibit the fuel meter 21 from moving for fuel increase at the time of the quick acceleration. Correspondingly, a diaphragm 27 must have its pressure receiving area increased. This makes the boost actuator 26 large as a whole as well as in the prior art 1.

Under the above circumstance, the present invention has been creased. It has an object to secure an ability of starting an engine by a boost actuator having a simple and inexpensive downsized structure without requiring a driving force strong enough to overcome the return spring of the boost actuator for placing the fuel meter at the starting fuel increase position. Further, it has another object to provide a fuel limitation device which inhibits the excessive fuel supply when making the warm start and prevents the generation of black smoke and the wasteful fuel consumption.

The present invention has the same basic structure as the prior art 1 (see FIG. 11), for example, as shown in FIGS. 1, 2, 8, 9 and 10.

A fuel meter 21 of a fuel injection pump for an engine with a supercharger is made movable for fuel metering through a governor lever 14. A swing lever 31 is supported by a pivot axis (Q) and has a power input point (J) which engages with an output rod 30 of a diaphragm-type boost actuator 26. The swing lever 31 has a power output point (K) which faces the fuel meter 21 from a fuel increase side (R) of the fuel meter 21. If the boost actuator 26 operates in response to a delayed rise of a pressure (P) supercharged to the engine (E), the power output point (K) of the swing lever 31 inhibits the fuel meter 21 from moving for fuel increase.

In a fuel limitation device for an engine with a supercharger having the foregoing basic structure, an invention as set forth in claim 1 (a first invention), for example, as shown in FIGS. 1, 2 and 8, connectably and separably opposes an output portion 17 of the governor lever 14 to the fuel meter 21 from a fuel increase side (R) and urges the fuel meter 21 by a start spring 18 toward a starting fuel increase side. An actuator 40 displaces the pivot axis (Q) to position the power output point (K) of the swing lever 31 on the fuel increase side (R) or a fuel decrease side (L). When making a cold start of the engine, the fuel meter 21 is received at a starting fuel increase position (St) by the power output point (K) positioned on the fuel increase side (R). On the other hand, when making a warm start of the engine, the fuel meter 21 is received at a starting fuel decrease position (Ls) by the power output point (K) positioned on the fuel decrease side (L). Here, the cold start means to start the engine before it becomes warm and the warm start means to start it in a warm environment (including the start after it has become warm to wait as it is, which is applicable to the later recitation).

In a fuel limitation device for an engine with a supercharger having the foregoing basic structure, an invention as set forth in claim 2 (a second invention), for example, as shown in FIGS. 9 and 10, opposes connectably and separably an output portion 17 of the governor lever 14 to the fuel meter 21 from the fuel increase side (R) and urges the fuel meter 21 by a start spring 18 toward a starting fuel increase side. An actuator 40 loaded on the output rod 30 of the boost actuator 26 reversely displaces the power input point (J) of the swing lever 31 to position the power output point (K) of the swing lever 31 on the fuel increase side (R) or a fuel decrease side (L).

When making the cold start of the engine, the power output point (K) positioned on the fuel increase side (R) receives the fuel meter 21 at a starting fuel increase position (St). On the other hand, when making the warm start of the engine, the power output point (K) positioned on the fuel decrease side (L) receives the fuel meter 21 at a starting fuel decrease position (Ls). Here, to reversely displace by the actuator 40 means that the output rod 30 of the boost actuator 26 operates in a direction reverse to a direction in which the actuator 40 loaded on the output rod 30 operates.

In the fuel limitation device for the engine with the supercharger as set forth in claim 1 or 2, an invention of claim 3 constructs the actuator 40 by a temperature sensitive actuator 32.

In the fuel limitation device for the engine with the supercharger as set forth in claim 3, an invention of claim 4 makes the temperature sensitive actuator 32 project the output rod 35 owing to temperature sensitive volume expansion of a wax accommodated in a vessel 34.

In the fuel limitation device for the engine with the supercharger as set forth in claim 1 or 2, an invention of claim 5 provides a temperature sensor 41 which senses the environment temperature of the engine and an electric driving circuit 42 which operates the actuator 40 by a sensed signal (N) sent from the temperature sensor 41. When making the cold start of the engine, the actuator 40 does not operate. But when making the warm start of the engine, the actuator 40 operates.

In the fuel limitation device for the engine with the supercharger, an invention of claim 6 constructs the actuator 40 by a piston actuator 44 which operates with an engine intake negative pressure, an engine back pressure or a lubricant pressure. When starting the engine, the piston actuator 44 does not operate to result in receiving the fuel meter at the starting fuel increase position (St) by the power output point (K) of the swing lever 31.

FUNCTION AND EFFECT OF THE INVENTION

The present invention brings forth the following functions and effects.

(a) According to the invention of claim 1 (a first invention), in the fuel limitation device for the engine with the supercharger having the foregoing basic structure, the output portion 17 of the governor lever 14 is connectably and separably opposed to the fuel meter 21 from the fuel increase side (R) and the start spring 18 urges the fuel meter 21 toward the starting fuel increase side. Therefore, the diaphragm-type boost actuator 26 can be adapted to produce a small output and be made compact.

In a normal operation, the fuel meter 21 of the fuel injection pump is urged by the start spring 18 toward the fuel increase side and follows the operation of the output portion 17 of the governor lever 14. On the other hand, when strongly pulling the governor lever 14 toward the fuel increase side (R) by a governor spring force through the speed control lever 12 at the time of quick acceleration, the output portion 17 of the governor lever 14 separates from the fuel meter 21 and moves toward the fuel increase side (R). And a governing force (GF) does not act on the fuel meter 21 but only an urging force of the start spring 18 acts thereon. At this time, it is sufficient setting a resilient force of the return spring 28 of the boost actuator 26 to have a strength substantially balancing the urging force of the start spring 18 in order that the boost actuator 26 can exert its boost function to inhibit the fuel meter 21 from moving for fuel increase. In short, it is possible to reduce the resilient force of the return spring 28 of the boost actuator 26 much more than the prior arts, which results in the possibility of remarkably decreasing the pressure receiving area of the diaphragm 27 which resists it. In consequence, the boost actuator 26 can be adapted to produce a small output and be made compact.

(b) In addition to the function and effect (a), the invention of claim 1 (the first invention) brings forth the following ones.

The actuator 40 displaces the pivot axis (Q) of the swing lever 31 to position the power output point (K) of the swing lever 31 on the fuel increase side (R) or the fuel decrease side (L). Therefore, when making the cold start of the engine, the start spring 18 pushes out the fuel meter 21 to the starting fuel increase position (St). In short, this does not requires the push rod (M) (see prior art 1) which pushes out the fuel meter 21 to the starting fuel increase position (St) against the return spring 28 of the diaphragm-type boost actuator 26. This results in a simple and inexpensive structure.

(c) According to the invention of claim 1 (the first invention), when making the cold start of the engine, the power output point (K) positioned on the fuel increase side (R) receives the fuel meter 21 at the starting fuel increase position (St). When making the warm start of the engine, the power output point (K) positioned on the fuel decrease side (L) receives the fuel meter 21 at the starting fuel decrease position (Ls). Therefore, it is possible to inhibit the excessive fuel supply when making the warm start of the engine, thereby preventing the generation of black smoke or the like, while securing an ability of making the cold start of the engine.

More specifically, when making the cold start of the engine, the fuel meter 21 of the fuel injection pump is received at the staring fuel increase position (St) by the power output point (K) positioned on the fuel increase side (R). This supplies fuel in an amount necessary enough to make the cold start of the engine, thereby securing the ability of making the cold start.

Further, when making the warm start, the fuel meter 21 of the fuel injection pump is received at the starting fuel decrease position (Ls) by the power output point (K) positioned on the fuel decrease side (L). This inhibits the excessive fuel supply to result in preventing the generation of black smoke and the like.

(d) The invention of claim 2 (a second invention) as well as the first invention connectably and separably opposes the output portion 17 of the governor lever 14 to the fuel meter 21 from the fuel increase side (R) and urges the fuel meter 21 by the start spring 18 toward the starting fuel increase. When making the cold start of the engine, the fuel meter 21 is received at the starting fuel increase position (St) by the power output point (K) positioned on the fuel increase side (R). When making the warm start of the engine, the fuel meter 21 is received at the starting fuel decrease position (Ls) by the power output point (K) positioned on the fuel decrease side (L). Therefore, it brings forth the same functions and effects (a) and (c) as the first invention does.

(e) In addition, according to the invention of claim 2 (the second invention), for example, as shown in FIGS. 9 and 10, the actuator 40 loaded on the output rod 30 of the boost actuator 26 reversely displaces the power input point (J) of the swing lever 31 to position the power output point (K) of the swing lever 31 on the fuel increase side (R) or the fuel decrease side (L). When making the cold start of the engine, the start spring 18 pushes out the fuel meter 21 to the starting fuel increase position (St). In short, this does not require the push rod (M) (prior art 1) which pushes out the fuel meter 21 to the starting fuel increase position (St) against the return spring 28 of the diaphragm-type boost actuator 26, which results in a simple and inexpensive structure.

(f) In the fuel limitation device for the engine with the supercharger as set forth in claim 1 or 2, the invention of claim 3 constructs the actuator 40 by the temperature sensitive actuator 32. Accordingly, it can inhibit the excessive fuel supply when making the warm start, thereby preventing the generation of black smoke or the like, while securing the ability of making the cold start.

(g) According to the invention of claim 4, in the fuel limitation device for the engine with the supercharger as set forth in claim 3, the temperature sensitive actuator 32 projects the output rod 35 owing to the temperature sensitive volume expansion of the wax accommodated in the vessel 34. This can put the temperature sensitive actuator 32 into practice with a simple structure and at a low cost.

(h) In the fuel limitation device for the engine with the supercharger as set forth in claim 1 or 2, the invention of claim 5 provides the temperature sensor 41 which senses the environment temperature of the engine, and the electric driving circuit 42 which operates the actuator 40 by the sensed signal (N) sent from the temperature sensor 41. When making the cold start, the actuator 40 does not operate, and when making the warm start, it operates. This can limit the excessive fuel supply when making the warm start, thereby preventing the generation of black smoke and the wasteful fuel consumption, while assuring the ability of making the cold start of the engine.

(i) In the fuel limitation device for the engine with the supercharger as set forth in claim 1 or 2, the invention of claim 6 constructs the actuator 40 by a piston actuator 44 which operates with an engine intake negative pressure, an engine back pressure or a lubricant pressure. When starting the engine, the piston actuator 44 does not operate to thereby receive the fuel meter 21 at the starting fuel increase position (St) by the power output point (K) of the swing lever 31. Consequently, this cancels the fuel limitation function of the boost actuator 26 irrespective of the engine's environment temperature and therefore secures the starting fuel increase to facilitate the engine start.

For example, like the engine generator and so on, in the case where the engine has a large dragging load, even when making the warm start, failure to start occurs unless the starting fuel increase is secured. However, the present invention can solve the start failure occurring in the case where the engine has a large dragging load.

BRIEF DESCRIPTION OF THE DRAWINGS

FIG. 4 explains an operation of a temperature sensitive actuator according to the first invention.

FIG. 5 explains an operation of an essential part of the first invention.

DESCRIPTION OF THE PREFERRED EMBODIMENTS

Figure 1:
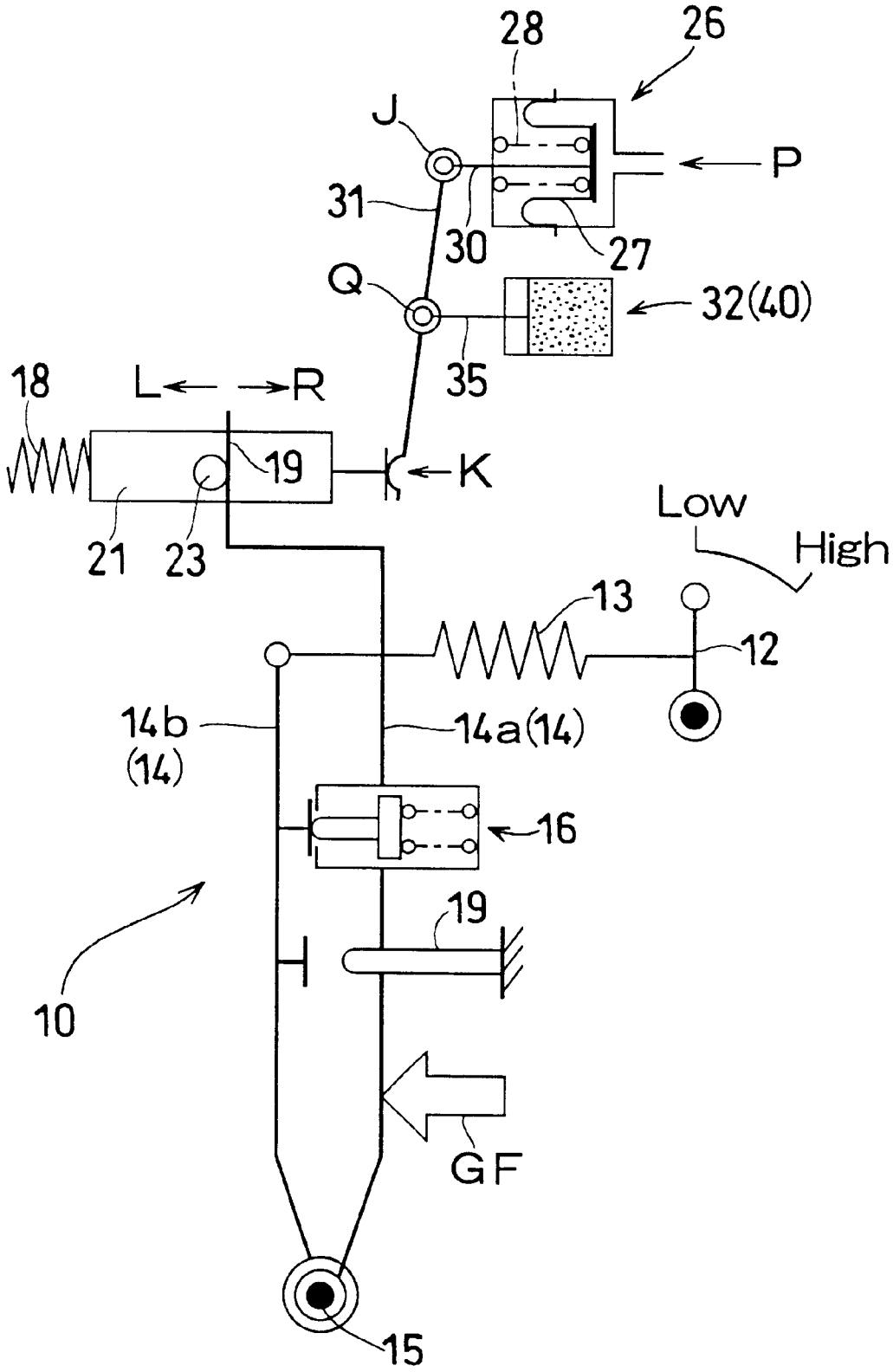
FIG. 1 is a schematic view of a fuel limitation device for an engine with a supercharger, according to a first invention.
Figure 2:
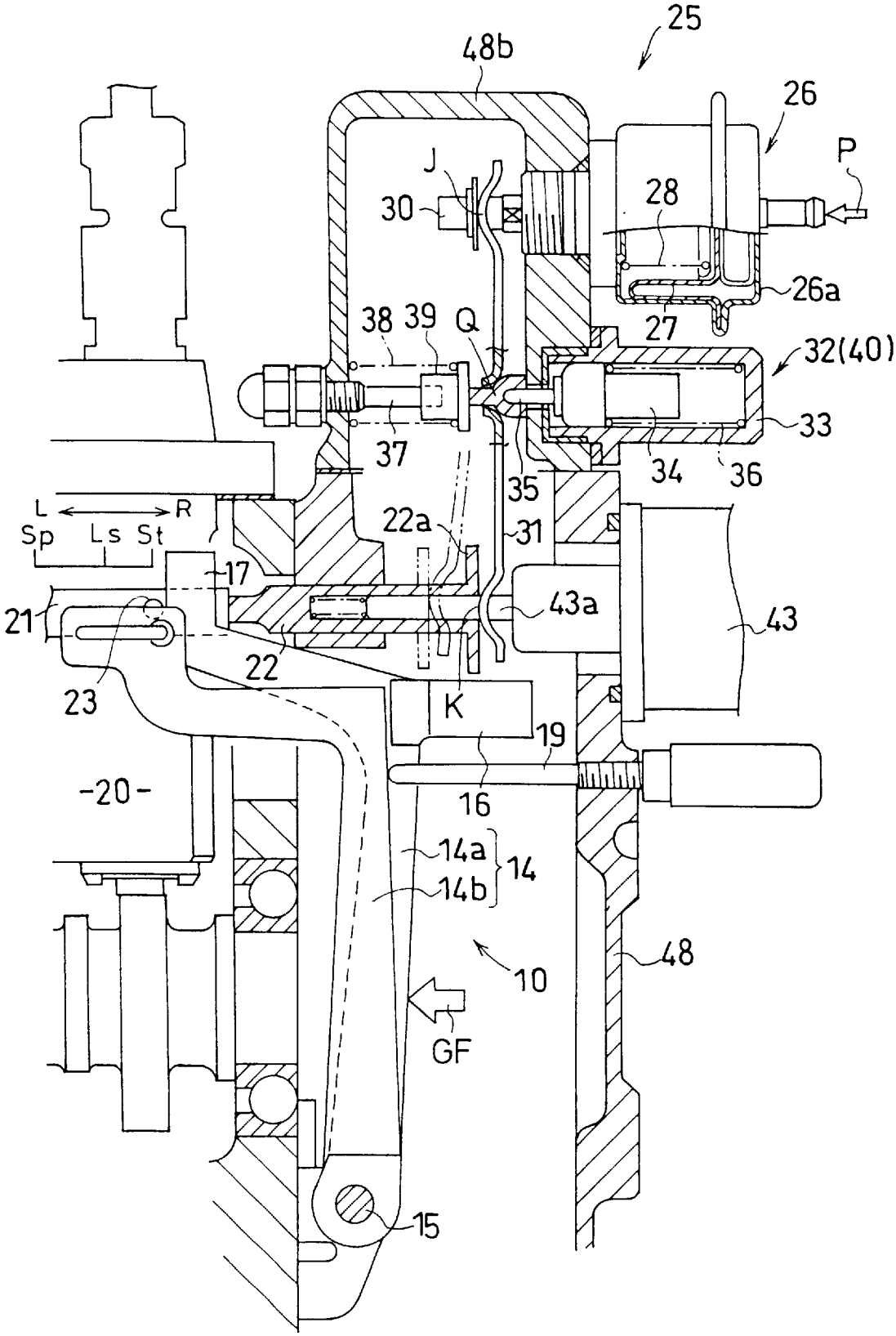
FIG. 2 is a vertical sectional view of a fuel limitation device for an engine with a supercharger according to a first embodiment of the first invention.

Hereafter, explanation is given for embodiments of the present invention based on the attached drawings. FIG. 1 is a schematic view of a fuel limitation device for an engine with a supercharger, according to an invention as defined in claim 1 (hereafter referred to as a 'first invention'). FIG. 2 is a vertical sectional view of a fuel limitation device according to a first embodiment of the first invention.

A centrifugal governor 10 to which the first invention is applied comprises a first lever 14*a* and a second lever 14*b*, of which a double governor lever 14 is composed as shown in FIGS. 1 and 2. A torque-up device 16 is interposed between the first lever 14*a* and the second lever 14*b* to form an integral and swingable structure.

The fuel limitation device 25 according to the first invention has the same basic structure as the prior art 1 (FIG. 11) and the prior art 2 (FIG. 12), as shown in FIGS. 1 and 2.

It comprises a fuel meter 21 of a fuel injection pump for an engine with a supercharger, made movable for fuel metering through the governor lever 14. A swing lever 31 is supported by a pivot axis (Q) and has a power input point (J) which engages with an output rod 30 of a diaphragm-type boost actuator 26. The swing lever 31 has a power output point (K) faced to the fuel meter 21 from a fuel increase side (R) of the fuel meter 21. If the boost actuator 26 operates in response to a delayed rise of a pressure (P) supercharged to the engine (E), the power output point (K) of the swing lever 31 inhibits the fuel meter 21 from moving for fuel increase.

A characterizing structure of the first invention is explained below.

The first lever 14*a* has at its upper end an output portion 17, which connectably and separable opposes to a rack pin 23 provided at a fuel meter (hereafter referred to as a 'fuel metering rack 21') of a fuel injection pump 20 from the fuel increase side (R). A start spring 18 urges the fuel metering rack 21 toward a starting fuel increase side. This is in an attempt to adapt the boost actuator 26 so as to produce a small output and to make it compact.

The second lever 14*b* is urged toward the fuel increase side (R) by an extension force of a governor spring 13. The first lever 14*a* is pushed toward a fuel decrease side (L) by a governing force (GF). The governor lever 14 swings by a balance between them. When the engine is in normal operation, the fuel metering rack 21 of the fuel injection pump is urged toward the starting fuel increase side by the start spring 18 and follows a swing of the output portion 17 of the governor lever 14.

On the other hand, at the time of quick acceleration, when a speed control lever 12 is strongly pulled to strongly pull the second lever 14*b* toward the fuel increase side (R) through the governor spring 13, the first lever 14*a* moves together with the second lever 14*b* toward the fuel increase side (R) and the output portion 17 separates from the rack pin 23. And the governing force (GF) does not act on the fuel metering rack 21 but an urging force of the start spring 18 acts toward the fuel increase side (R). At this time, the boost actuator 26 exerts a boost function (hereafter referred to as 'fuel limitation function') to inhibit the fuel metering rack 21 from moving for fuel increase.

In order for the boost actuator 26 to exert the fuel limitation function, it is sufficient if a resilient force of a return spring 28 of the boost actuator 26 is set to have a strength substantially balancing the urging force of the start spring 18. In short, by reducing the resilient force of the return spring 28 much more than the prior arts, it is possible to reduce a pressure receiving area of a diaphragm 27 which resists it. This can adapt the boost actuator to produce a small output and make it compact.

As shown in FIGS. 1 and 2, the swing lever 31 has the power output point (K) which engages with the fuel metering rack 21 of the fuel injection pump 20 and faces it from the fuel increase side (R). After the engine has started, if the boost actuator 26 operates in response to a delayed rise of a pressure (P) supercharged to the engine (E), the power output point (K) of the swing lever 31 inhibits the fuel metering rack 21 from moving for fuel increase. This limits excessive fuel supply accompanying the delayed rise of the supercharged pressure (P) at the time of quick acceleration and the like, thereby preventing the generation of black smoke and the wasteful fuel consumption.

The boost actuator 26, as shown in FIG. 2, comprises a casing 26*a*. The casing 26*a* includes the diaphragm 27 which receives the pressure (P) supercharged to the engine (E) and the return spring 28 which resists the diaphragm 27. The supercharged pressure (P) pushes the diaphragm 27 to project the output rod 30. The projected output rod 30 acts on the power input point (J) of the swing lever 31 supported by the pivot axis (Q).

The pivot axis (Q) is displaced by an actuator 40. The power output point (K) of the swing lever 31 positions on either of the fuel increase side (R) and the fuel decrease side (L) in correspondence with output of the actuator 40. More specifically, when making a cold start of the engine, the actuator 40 does not operate. Therefore, the power output point (K) positioned on the fuel increase side (R) receives the fuel metering rack 21 at a starting fuel increase position (St). When making a warm start, the power output point (K) positioned on the fuel decrease side (L) receives the fuel metering rack 21 at a starting fuel decrease position (Ls). Further, in this first embodiment, as shown in FIGS. 2 and 3, the swing lever 31 has a middle portion supported by the pivot axis (Q), and has the power input point (J) and the power output point (K) set to its upper end portion and lower end portion, respectively.

Figure 11:
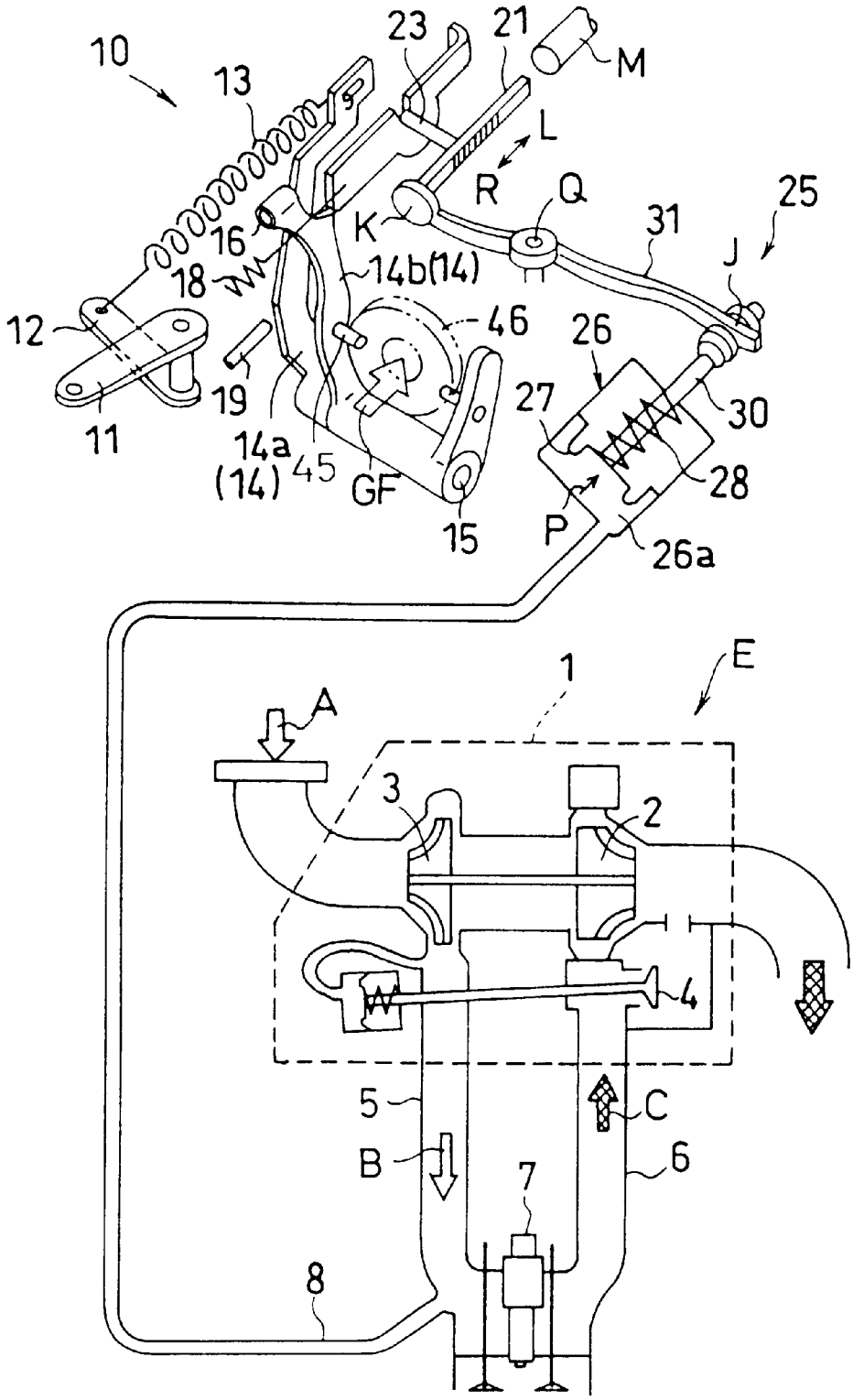
FIG. 11 PRIOR ART
FIG. 11 shows an outlined view of a fuel limitation device for an engine with a supercharger, according to prior art 1.

The above structure does not need such a push rod (M) as employed in the prior art 1 (FIG. 11). In other words, it does not require a driving force strong enough to push out the fuel metering rack 21 against the return spring 28 of the boost actuator 26. And it attempts to position the fuel metering rack 21 at the starting fuel increase position (St) when making the cold start of the engine through providing the pivot axis (Q) of the swing lever 31 displaceable by the actuator 40.

When making the cold start of the engine, no boost pressure acts on the boost actuator 26 and the output rod 30 of the boost actuator 26 which engages with the power input point (J) of the swing lever 31 is retracted. The pivot axis (Q) supporting the swing lever 31 positions on the fuel increase side (R) as well as the power output point (K) of the swing lever 31. The start spring 18 urges the fuel metering rack 21 of the fuel injection pump 20 toward the fuel increase side (R), thereby allowing it to position at the starting fuel increase position (St). This cancels the fuel limitation function of the boost actuator 26 and supplies fuel in an amount necessary for making the cold start to assure the ability of starting the engine.

Figure 3:
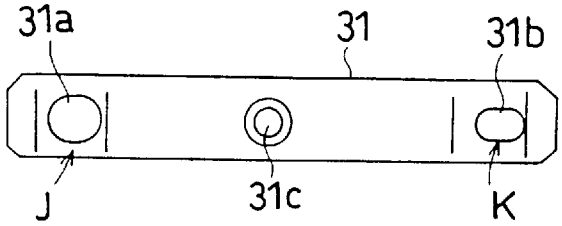
FIG. 3 is a plan view of a swing lever according to the first invention.

The swing lever 31, as shown in FIG. 3, has its power input point (J) opened to provide a hole 31*a* which engages with the output rod 30 and has its power output point (K) opened to provide a hole 31*b* through which an operation rod 43*a* of an engine stop solenoid 43 extends. Additionally, it has the middle portion opened to provide a hole 31*c* through which the pivot axis (Q) extends. As mentioned above, the fuel metering rack 21 is urged by the start spring 18 toward the fuel increase side. When starting the engine, a slidably provided damper rod 22 has its leading end 22*a* brought into pressure contact with the power output point (K) of the swing lever 31.

Figure 4A:
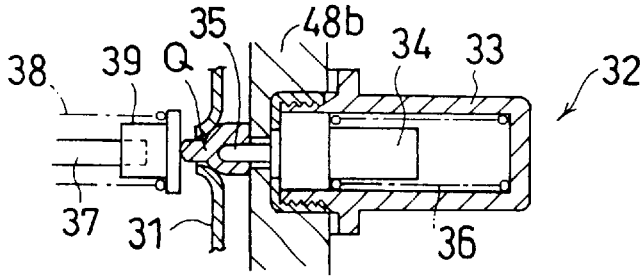
FIG. 4(A) shows it in operation when making a cold start and FIG. 4(B) illustrates it in operation when making a warm start.
Figure 4B:
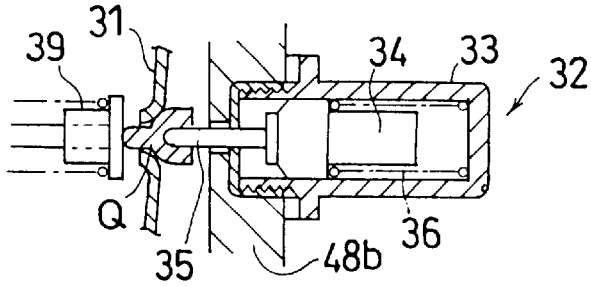

The actuator 40 comprises a temperature sensitive actuator 32 as shown in FIGS. 2 and 4. Here, FIG. 4 explains how the temperature sensitive actuator 32 operates. While FIG. 4(A) shows it inoperative. FIG. 4(B) illustrates it operative. This temperature sensitive actuator 32 comprises a casing 33 attached to a wall 48*b* of the engine, a vessel 34 housed within the casing 33, a receiving spring 36 which can resiliently receive the vessel 34, an output rod 35 and the pivot axis (Q) attached at a leading end portion of the output rod 35 so as to cover it. The output rod 35 projects owing to temperature sensitive volume expansion of a wax accommodated in the vessel 34 to advance and retract the pivot axis (Q) supporting the swing lever 31. The actuator 40 can be constructed simply and inexpensively by employing the temperature sensitive actuator 32. The bimetal and the shape memory means can be used instead of the temperature sensitive actuator 32.

As shown in FIG. 4, in the case where the temperature sensitive actuator 32 senses a temperature, for example, below 15 degrees C., it does not operate so as not to project the output rod 35. This cancels the fuel limitation function of the boost actuator 26 exerted when starting the engine. Further, in the case where the temperature sensitive actuator 32 senses a temperature of, for example, at least 22 degrees C., it projects the output rod 35 to displace the pivot axis (Q) supporting the swing lever 31 toward the fuel decrease side (L). When making the warm start, the fuel metering rack 21 is placed at a starting fuel decrease position (Ls). The wax accommodated in the vessel 34 changes from solid to liquid at a temperature within the range of 15 degrees C. and 25 degrees C. The maximum projection length of the output rod 35 comes to be about 3.5 mm.

There is provided a contact means 39 which is resiliently pushed by another return spring 38 and is opposed to the pivot axis (Q). A regulation pin 37 is provided so as to be able to advance and retreat with respect to the wall 48*b*. The contact means 39 is attached to a leading end portion of the regulation pin 37 so as to cover the leading end. As the engine's environment temperature lowers, it enables the another return spring 38 to push and return the output rod 35 of the temperature sensitive actuator 32 into the vessel 34. The regulation pin 37 regulates the projection length of the output rod 35 of the temperature sensitive actuator 32. In the event that the output rod 35 projects over a predetermined value owing to expansion of the wax, the vessel 34 retreats against the receiving spring 36 as shown in FIG. 4(B).

Figure 5A:
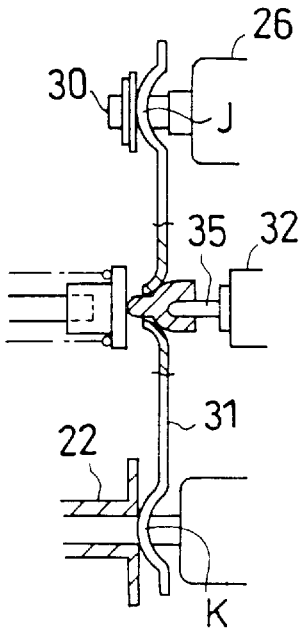
FIG. 5(A) shows it in operation when making the cold start and FIG. 5(B) illustrates it in operation when making the warm start.
Figure 5B:
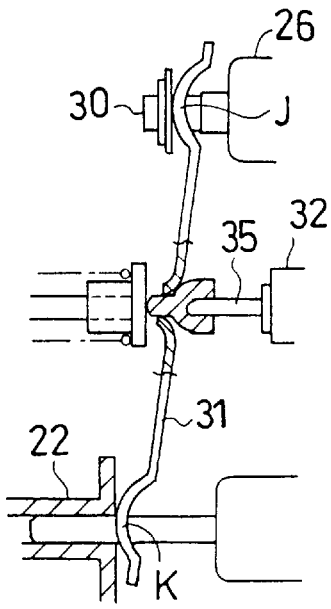
Figure 5C:
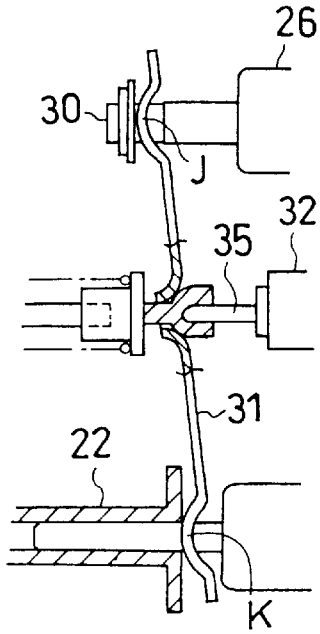
FIG. 5(C) shows it after quick acceleration has been effected in pursuant to the engine start.

FIG. 5 explains how an essential part of the first embodiment operates. FIG. 5(A) shows it when making the cold start and FIG. 5(B) illustrates it when making the warm start. FIG. 5(C) shows it after quick acceleration has been effected in pursuant to the engine start.

When making the cold start, as shown in FIG. 5(A), the output rod 30 of the boost actuator 26 does not project as well as the output rod 35 of the temperature sensitive actuator 32. The power output point (K) of the swing lever 31 positions on the starting fuel increase side. The fuel metering rack 21 of the fuel injection pump 20 is placed at the starting fuel increase position (St) through the damper rod 22. This assures the ability of making the cold start of the engine.

When making the warm start (in the case where the environment temperature is, for instance, at least 22 degrees C.), as shown in FIG. 5(B), the output rod 30 of the boost actuator 26 does not project, but the output rod 35 of the temperature sensitive actuator 32 projects. The power output point (K) of the swing lever 31 positions on the starting fuel decrease side. The fuel metering rack 21 of the fuel injection pump 20 is placed at a starting fuel decrease position (Ls) through the damper rod 22. This inhibits the excessive fuel supply when making the warm start, thereby preventing the generation of black smoke and the like.

When the speed control lever is operated for quick acceleration after the engine has started, as shown in FIG. 5(C), the output rod 30 of the boost actuator 26 projects in response to a delayed rise of a supercharged pressure (P). Therefore, the power output point (K) of the swing lever 31 performs a delayed displacement toward the fuel increase side (R). The fuel metering rack 21 of the fuel injection pump 20 effects a delayed movement toward the fuel increase side (R) through the damper rod 22. FIG. 5(C) shows a case where the environment temperature is, for example, at least 22 degrees C. The output rod 35 of the temperature sensitive actuator 32 projects. When the environment temperature is below 15 degrees C., the fuel limitation function of the boost actuator 26 is cancelled.

Figure 6:
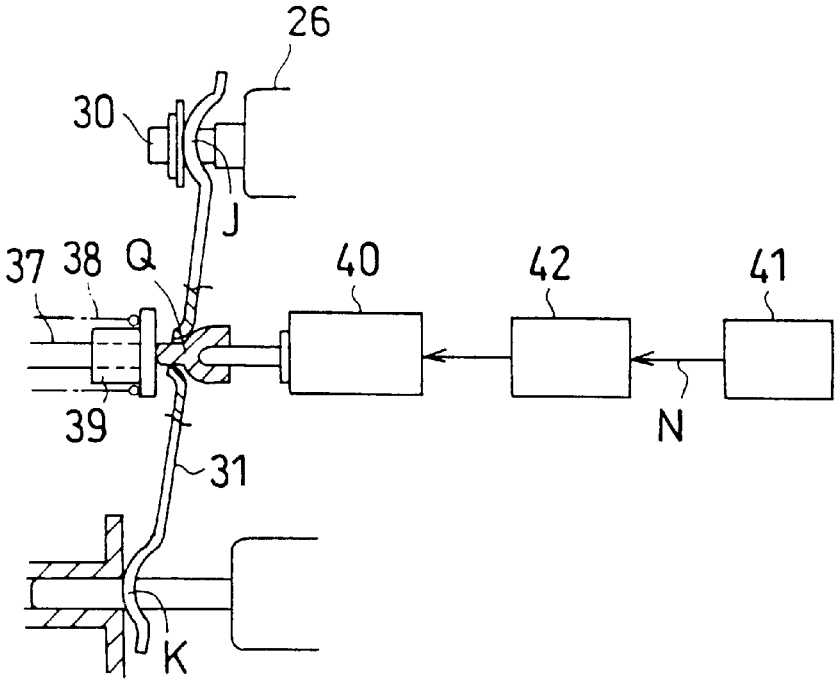
FIG. 6 shows a first modification of the first invention and is similar to FIG. 5(B)

FIG. 6 shows a first modification of the first invention and is similar to FIG. 5(B). The first modification provides a temperature sensor 41 which senses the engine's environment temperature, and an electric driving circuit 42 which operates the actuator 40 by a sensed signal (N) sent from the temperature sensor 41. In the event the temperature sensor 41 senses a temperature below a predetermined one (for example, 15 degrees C.), the actuator 40 performs OFF-operation to cancel the fuel limitation function of the boost actuator 26 exerted when starting the engine. In the case where the sensed temperature is not less than the predetermined one (for example, 22 degrees C.), the actuator 40 performs ON-operation to displace the pivot axis (Q), thereby placing the fuel metering rack 21 at the starting fuel decrease position (Ls).

When making the cold start of the engine, the output rod 30 of the boost actuator 26 is retracted as well as in the first embodiment. Since the actuator 40 performs the OFF-operation, the pivot axis (Q) of the swing lever 31 does not displace. This retracts the power output point (K) of the swing lever 31, thereby allowing the fuel metering rack 21 of the fuel injection pump to be placed at the starting fuel increase position (St), which results in supplying fuel in an amount necessary for making the cold start of the engine to secure the ability of making the cold start.

When making the warm start, the output rod 30 of the boost actuator 26 is retracted and the pivot axis (Q) of the swing lever 31 is displaced by the ON-operation of the actuator 40. Thus the power output point (K) of the swing lever 31 confines the fuel metering rack 21 of the fuel injection pump to the starting fuel decrease position (Ls). This can inhibit the excessive fuel supply when making the warm start, thereby preventing the generation of black smoke and the like. The engine's environment temperature comprehends an engine's atmosphere temperature, a lubricant temperature, a cooling water temperature and the like.

Figure 7:
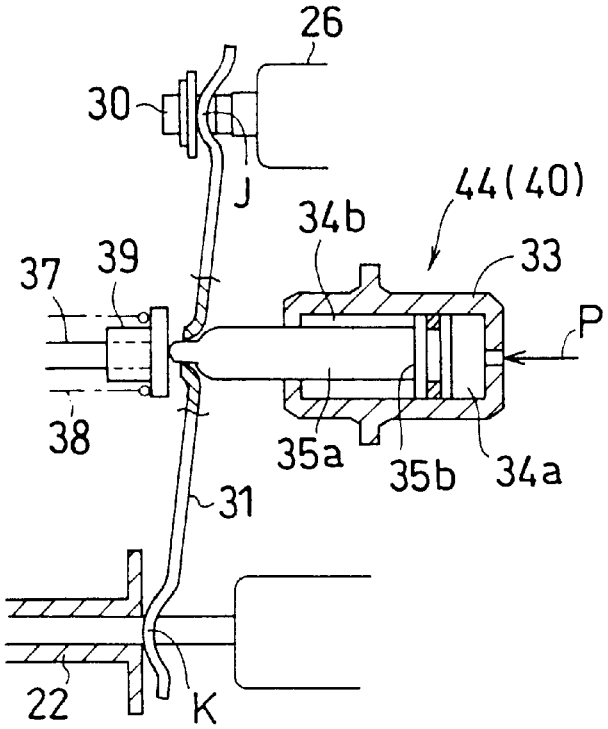
FIG. 7 shows a second modification of the first invention and is similar to FIG. 4(B)

FIG. 7 shows a second modification of the first invention and is similar to FIG. 5(B). In the second modification, the actuator 40 comprises a piston actuator 44 which operates with an engine intake negative pressure, an engine back pressure or a lubricant pressure. The piston actuator 44 slidably houses a piston 35*b* of a piston rod 35*a* within a cylinder case 33. The engine back pressure or the lubricant pressure is introduced into a piston actuation chamber 34*a* to push the piston 35*b*, thereby projecting the piston rod 35*a*. If the piston actuator 44 is operated by the engine intake negative pressure, the intake negative pressure is made to act on the piston actuation chamber 34*b* on the rod's side to project the piston rod 35*a*.

According to the second modification, when starting the engine, the piston actuator 44 does not operate to retract the piston rod 35*a* irrespective of the environment temperature. This cancels the fuel limitation function of the boost actuator 26 and secures the starting fuel increase to readily start the engine. For example, like the engine generator and so on, in the case where the engine has a large dragging load on starting, even when making the warm start, start failure occurs unless the starting fuel increase is secured. However, the present invention can solve the problem of the start failure occurring in the case where the engine has a large dragging load.

Figure 8:
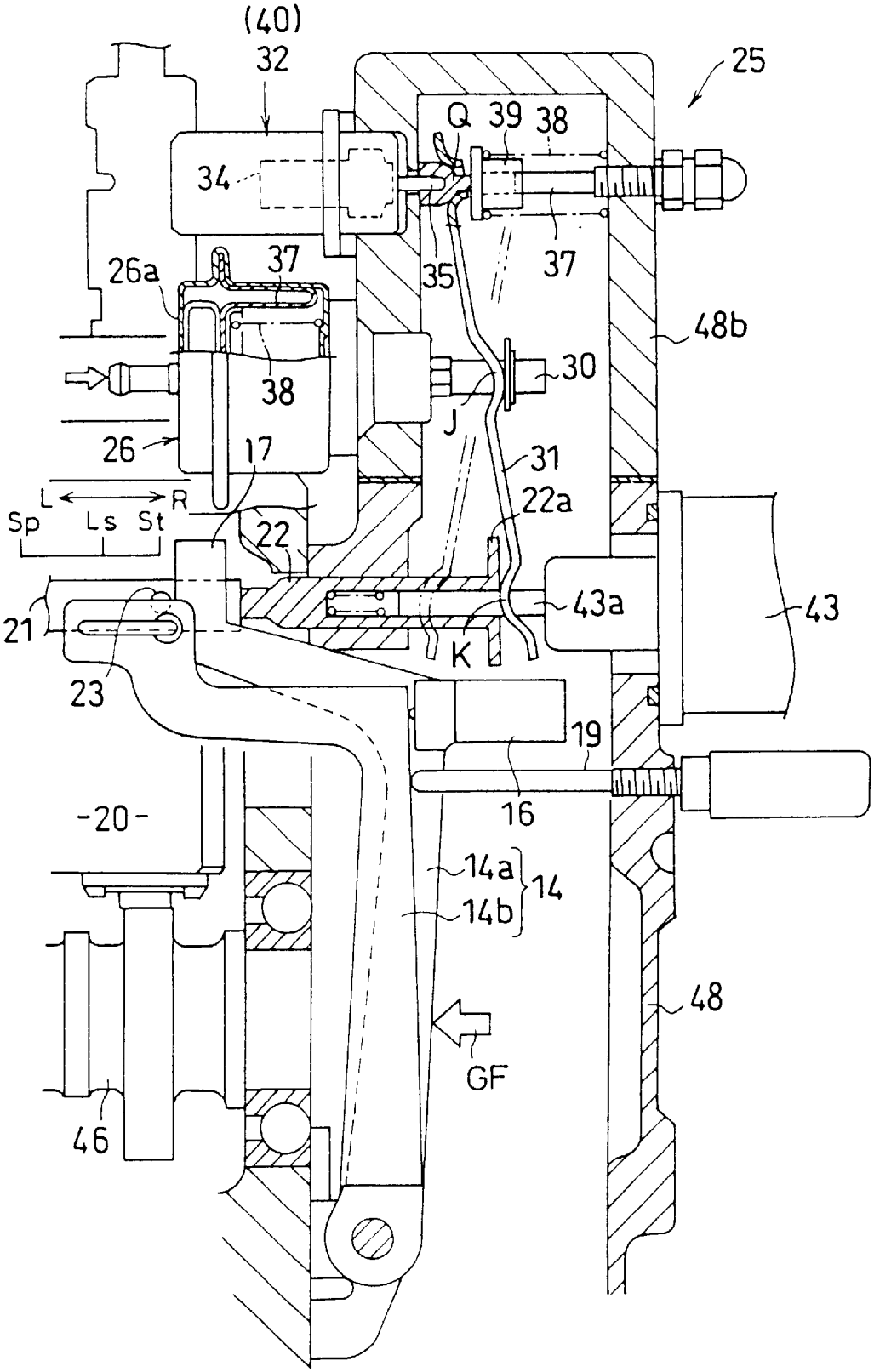
FIG. 8 shows a second embodiment of the first invention and is similar to FIG. 2.

FIG. 8 shows an second embodiment of the first invention and is similar to FIG. 2. This second embodiment differs from the first embodiment shown in FIG. 2 in that the power input point is exchanged by a fulcrum, but it is constructed in the same manner as the first embodiment on the other points.

The pivot axis (Q) supports the upper end portion of the swing lever 31. The power input point (J) and the power output point (K) are set to the middle portion and the lower end portion of the swing lever 31, respectively. The pivot axis (Q) of the swing lever 31 is displaceable by the actuator 40. When staring the engine, the actuator 40 does not operate to cancel the fuel limitation function of the boost actuator 26. After the engine has started, the boost actuator 26 maintains the fuel limitation function.

In the second embodiment, employable for the actuator 40 which displaces the pivot axis (Q) is the temperature sensitive actuator 32, the bimetal or that which is operated by the electric driving circuit as shown in FIG. 6. In addition, it is possible to use the piston actuator 44 which operates with the engine intake negative pressure, the engine back pressure or the lubricant pressure as shown in FIG. 7.

Figure 9:
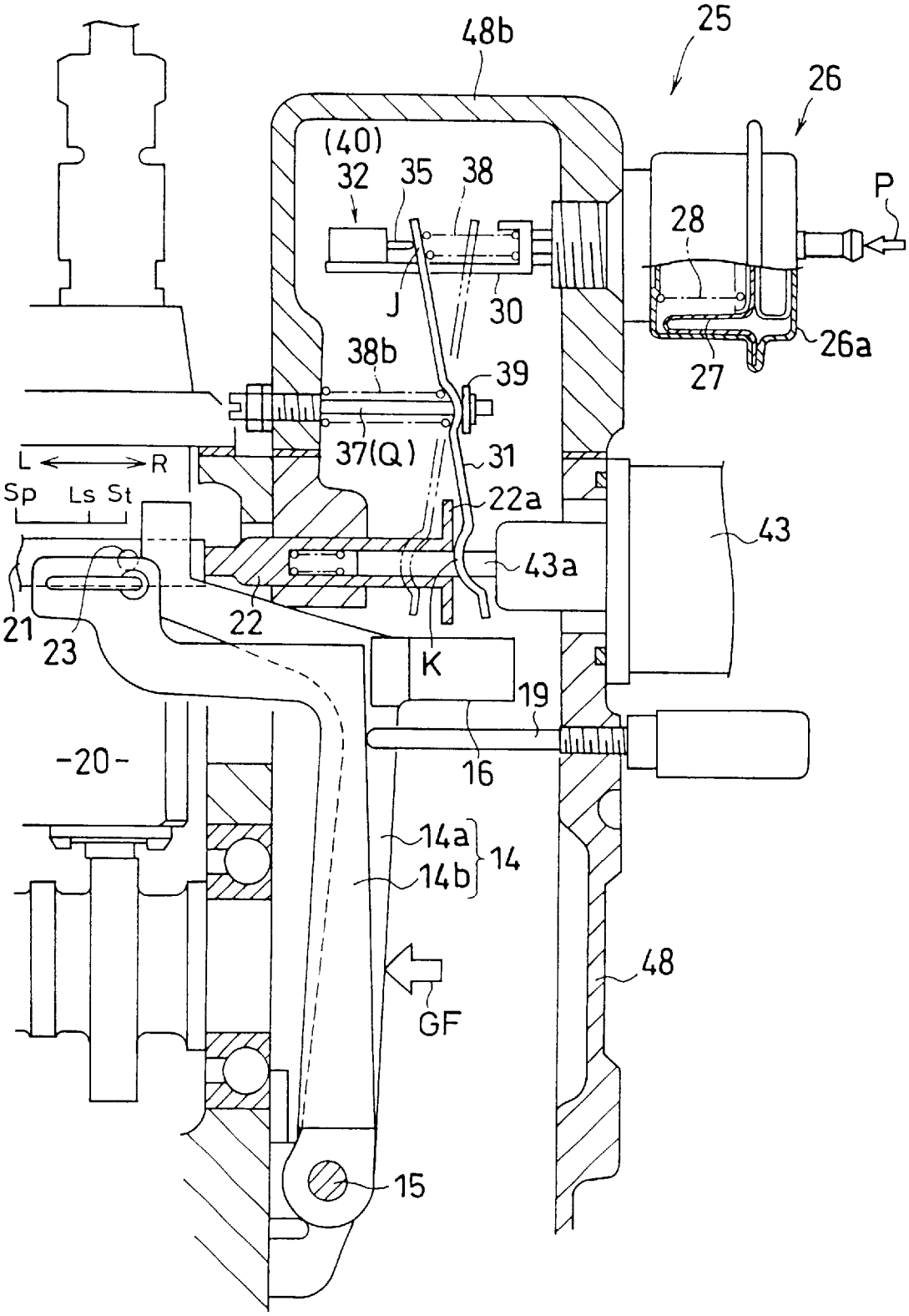
FIG. 9 shows a first embodiment of a second invention and is similar to FIG. 2.
Figure 12:
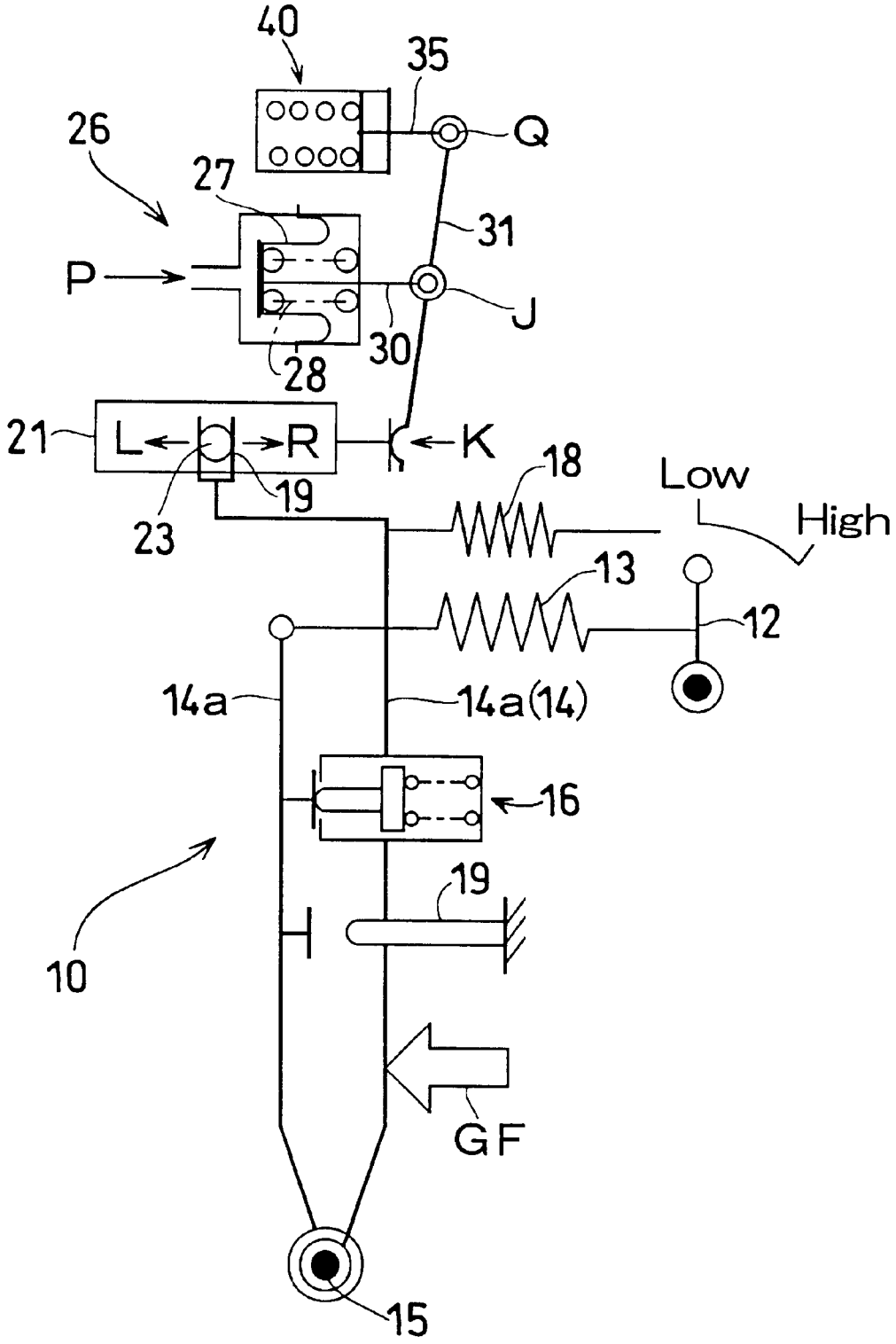
FIG. 12 PRIOR ART
FIG. 12 is a schematic view of a fuel limitation device for an engine with a supercharger, according to prior art 2.

FIG. 9 corresponds the invention as set forth in claim 2 (hereafter referred to as a 'second invention') and is similar to FIG. 2. A fuel limitation device 25 according to the second invention also has the same basic structure as that of either of the prior art 1 (FIG. 11) and the prior art 2 (FIG. 12). It is constructed in the same manner as the first invention except the following characterizing structure.

The second invention adapts the actuator 40 loaded on the output rod 30 of the boost actuator 26 so that it reversely displaces the power input point (J) of the swing lever 31 to thereby position the power output point (K) of the swing lever 31 on the fuel increase side (R) or the fuel decrease side (L). When making the cold start of the engine, the power output point (K) positioned on the fuel increase side (R) receives the fuel metering rack 21 at the starting fuel increase position (St). When making the warm start of the engine, the power output point (K) positioned on the fuel decrease side (L) receives the fuel metering rack 21 at the starting fuel decrease position (Ls). In this embodiment, the middle portion of the swing lever 31 is supported by a pin 37 of which the pivot axis (Q) is composed, a receiving washer 39 at a leading end portion of the pin 37 and a push spring 38*b*. The power input point (J) and the power output point (K) are set to the upper end portion and the lower end portion of the swing lever 31, respectively.

The above structure does not require such a push rod (M) as used by the prior art 1 (FIG. 11). In other words, it does not need a driving force strong enough to push out the fuel metering rack 21 against the return spring 28 of the boost actuator 26. The power input point (J) of the swing lever 31 is provided so as to be reversely displaceable by the actuator 40 in an attempt to place the fuel metering rack 21 at the starting fuel increase position (St) when making the cold start of the engine.

When making the cold start of the engine, no boost pressure acts on the boost actuator 26 and the output rod 30 is retracted. And the actuator 40 loaded on the output rod 30 of the boost actuator 26 and constraining the power input point (J) of the swing lever 31 does not operate. Therefore, the power output point (K) of the swing lever 31 supported at its middle portion by the pivot axis (Q) positions on the fuel increase side (R). On the other hand, a start spring (not shown) urges the fuel metering rack 21 of the fuel injection pump 20 toward the fuel increase side (R), thereby allowing it to be placed at the starting fuel increase position (St). This cancels the fuel limitation function of the boost actuator 26 and supplies fuel in an amount necessary for starting the engine to secure the ability of starting the engine.

When making the warm start (at the environment temperature of, for example, at least 22 degrees C.) the output rod 30 of the boost actuator 26 does not project but the output rod 35 of the temperature sensitive actuator 32 projects. Thus the power output point (K) of the swing lever 31 positions on the starting fuel decrease side and the fuel metering rack 21 of the fuel injection pump 20 is placed at the starting fuel decrease position (Ls) through the damper rod 22. This inhibits the excessive fuel supply when making the warm start and prevents the generation of black smoke and the like.

When the speed control lever is operated for quick acceleration after the engine has started, the output rod 30 of the boost actuator 26 performs a delayed projection in response to a delayed rise of the supercharged pressure (P). Therefore, the power output point (K) of the swing lever 31 displaces toward the fuel increase side also in delay. And the fuel metering rack 21 of the fuel injection pump 20 makes a delayed movement toward the fuel increase side (R) through the damper rod 22. In short, the boost actuator 26 maintains the fuel limitation function.

Figure 10:
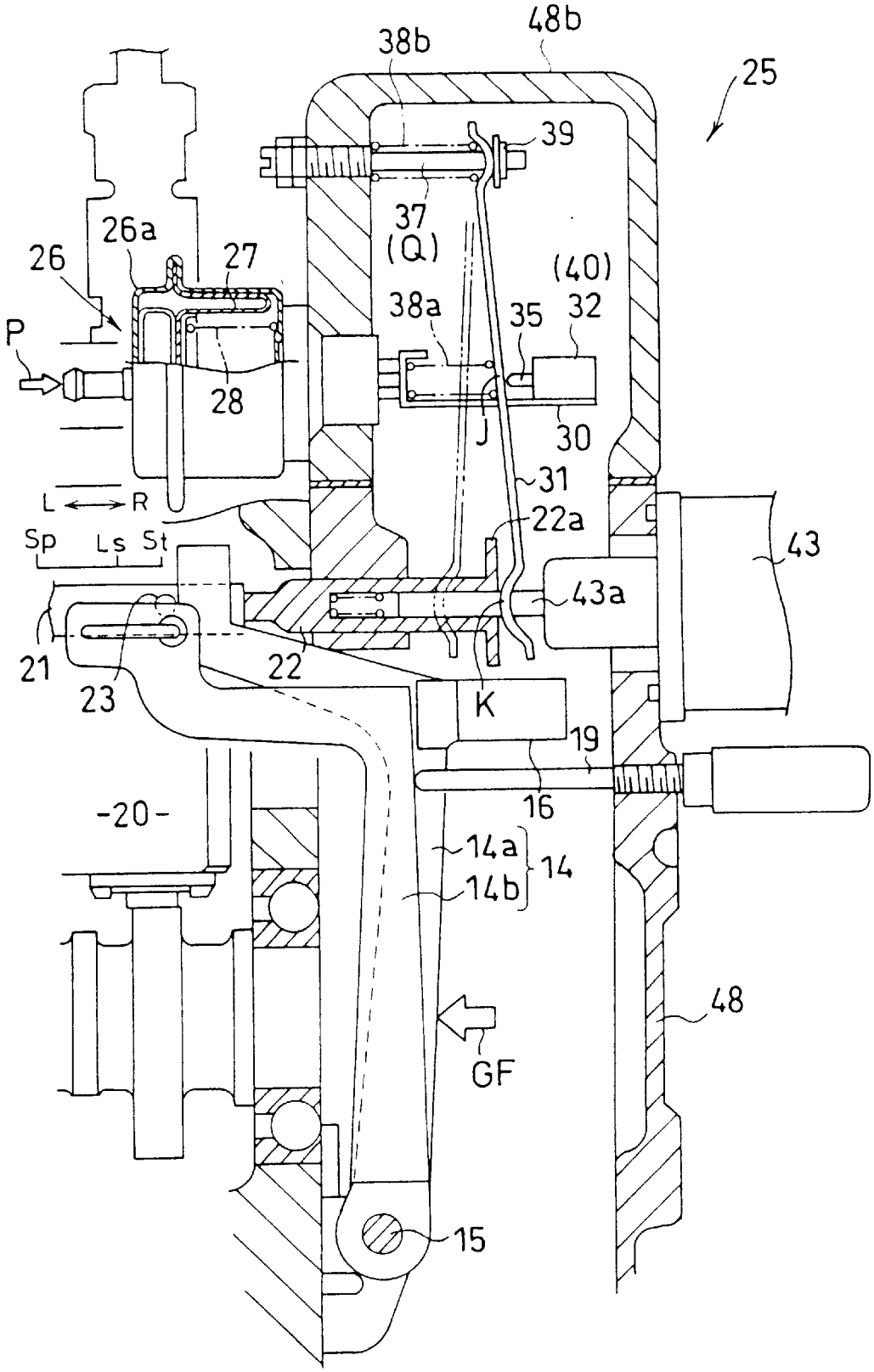
FIG. 10 shows a second embodiment of the second invention and is similar to FIG. 2.

FIG. 10 shows a modification of the second invention and is similar to FIG. 2. This modification differs from one shown in FIG. 9 in that the power input point is exchanged by a fulcrum. It is constructed in the same manner as that shown in FIG. 9 on the other points.

The swing lever 31 has its upper end portion supported by the pivot axis (Q), and has the power input point (J) and the power output point (K) set to the middle portion and the lower end portion of the swing lever 31, respectively. The power input point (J) of the swing lever 31 is made reversely displaceable by the actuator 40 loaded on the output rod 30 of the boost actuator 26. When starting the engine, the actuator 40 does not operate and therefore cancels the fuel limitation function of the boost actuator 26. After the engine has started, the boost actuator 26 maintains the fuel limitation function.

In the second invention, employable for the actuator 40 loaded on the output rod 30 of the boost actuator 26 is the temperature sensitive actuator 32, the bimetal or that which is operated by the electric driving circuit as shown in FIG. 6. In addition, as shown in FIG. 7, it is possible to use the piston actuator 44 which operates with the engine intake negative pressure, the engine back pressure or the lubricant pressure.

What is claimed is:

1. A fuel limitation device for an engine with a supercharger comprising:

a fuel meter (21) of a fuel injection pump (20) for the engine (E) with the supercharger, which is made movable for fuel metering through a governor lever (14); and a swing lever (31) supported by a pivot axis (Q) and having a power input point (J) which engages with an output rod (30) of a diaphragm-type boost actuator (26), the swing lever (31) having a power output point (K) faced to the fuel meter (21) from a fuel increase side (R) of the fuel meter (21), if the boost actuator (26) operates in response to a delayed rise of a pressure (P) supercharged to the engine (E), the power output point (K) of the swing lever (31) inhibiting the fuel meter (21) form moving for fuel increase, wherein the governor lever (14) has an output portion (17) connectably and separably opposed to the fuel meter (21) from the fuel increase side (R) and a start spring (18) urges the fuel meter (21) toward a starting fuel increase side, an actuator (40) displacing the pivot axis (Q) to position the power output point (K) of the swing lever (31) on the fuel increase side (R) or a fuel decrease side (L), when making a cold start of the engine, the power output point (K) positioned on the fuel increase side receiving the fuel meter (21) at a starting fuel increase position (St) and when making a warm start of the engine, the power output point (K) positioned on the fuel decrease side (L) receiving the fuel meter (21) at a starting fuel decrease position (Ls).

2. A fuel limitation device for an engine with a supercharger comprising:

a fuel meter (21) of a fuel injection pump (20) for the engine (E) with the supercharger, which is made movable for fuel metering through a governor lever (14); and a swing lever (31) supported by a pivot axis (Q) and having a power input point (J) which engages with an output rod (30) of a diaphragm-type boost actuator (26), the swing lever (31) having a power output point (K) faced to the fuel meter (21) from a fuel increase side (R) of the fuel meter (21), if the boost actuator (26) operates in response to a delayed rise of a pressure (P) supercharged to the engine (E), the power output point (K) of the swing lever (31) inhibiting the fuel meter (21) form moving for fuel increase, wherein the governor lever (14) has an output portion (17) connectably and separably opposed to the fuel meter (21) from the fuel increase side (R) and a start spring (18) urges the fuel meter (21) toward a starting fuel increase side, an actuator (40) loaded on the output rod 30 of the boost actuator 26 reversely displacing the power input point (J) of the swing lever (31) to position the power output point (K) of the swing lever (31) on the fuel increase side (R) or a fuel decrease side (L), when making a cold start of the engine, the power output point (K) positioned on the fuel increase side receiving the fuel meter (21) at a starting fuel increase position (St) and when making a warm start of the engine, the power output point (K) positioned on the fuel decrease side (L) receiving the fuel meter (21) at a starting fuel decrease position (Ls).

3. The fuel limitation device for the engine with the supercharger as set forth in claim 1 or 2, wherein the actuator (40) comprises a temperature sensitive actuator (32).

4. The fuel limitation device for the engine with the supercharger as set forth in claim 3, wherein the temperature sensitive actuator (32) projects an output rod (35) owing to temperature sensitive volume expansion of a wax accommodated in a vessel (34), thereby displacing the movable pivot axis (Q).

5. The fuel limitation device for the engine with the supercharger as set forth in claim 1 or 2, wherein there is provided a temperature sensor (41) which senses the engine's environment temperature, and an electric driving circuit (42) which operates the actuator (40) by a sensed signal (N) sent from the temperature sensor (41), when making the cold start, the actuator (40) being inoperative and when making the warm start, the actuator (4) displacing the pivot axis (Q).

6. The fuel limitation device for the engine with the supercharger as set forth in claim 1 or 2, wherein the actuator (40) comprises a piston actuator (44) which operates with an engine intake negative pressure, an engine back pressure or a lubricant pressure and when starting the engine, the piston actuator (44) being inoperative to make the power output point (K) of the wing lever (31) receive the fuel meter (21) at the starting fuel increase position (St).

* * * * *